United States Patent [19]

Lanusse

[11] 4,189,801

[45] Feb. 26, 1980

[54] FLUID PRODUCT PROJECTION APPARATUS FOR MAINTENANCE AND TREATMENT OF ALL SURFACES AS WELL AS THE BODY

[76] Inventor: Marie M. Lanusse, Embassy Ter. (Apt. 208), 3440, rue Durocher, Montreal H2X 2E2, Canada

[21] Appl. No.: 16,338

[22] Filed: Feb. 28, 1979

[51] Int. Cl.[2] ..... A46B 13/04

[52] U.S. Cl. ..... 15/29; 128/49

[58] Field of Search ..... 15/22 R, 22 C; 128/41, 128/46, 49, 62 R; 132/73.6, 75.8

[56] References Cited

U.S. PATENT DOCUMENTS 2,048,712 7/1936 Schramm ..... 128/49

3,968,789 7/1976 Simoncini ..... 128/49

FOREIGN PATENT DOCUMENTS 32304 10/1933 Netherlands ..... 128/49

*Primary Examiner*—Edward L. Roberts

*Attorney, Agent, or Firm*—Steinberg and Blake

[57] ABSTRACT

This invention relates to an apparatus for projecting a fluid product comprising a casing containing the fluid product, a working head rotatably mounted thereon, a hollow shaft jointly rotatable with the working head, an oscillating plate mounted in the casing and jointly rotatable with the hollow shaft, the end portions of the plate extending in confronting relationship to an electro-magnet secured to the casing and imparting to the working head an alternating rotary motion.

8 Claims, 6 Drawing Figures

Figure 1:
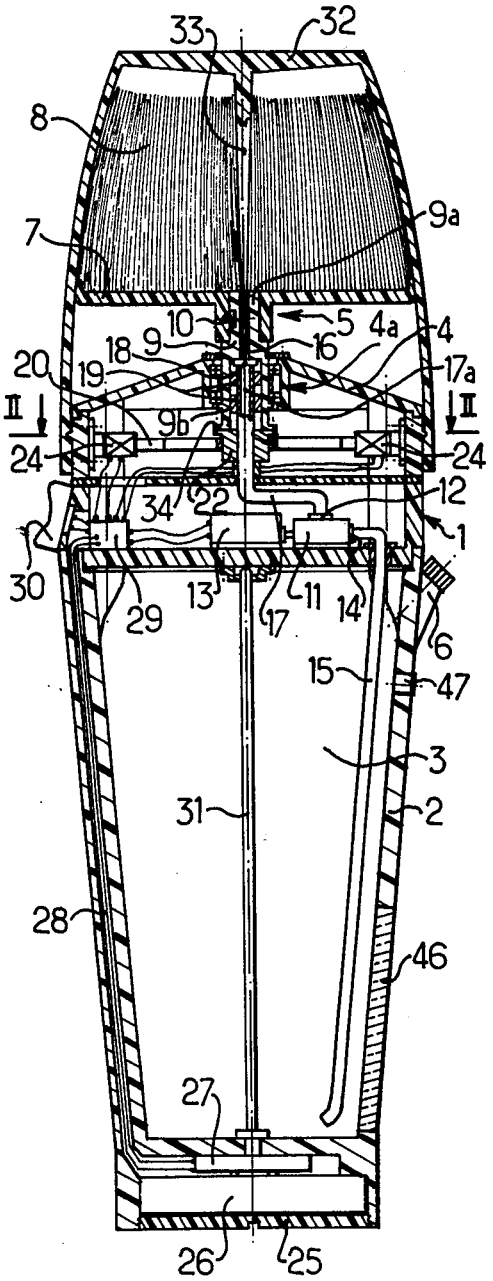

FLUID PRODUCT PROJECTION APPARATUS FOR MAINTENANCE AND TREATMENT OF ALL SURFACES AS WELL AS THE BODY

The present invention relates essentially to an apparatus for projecting fluid products for the maintenance or care and the treatment of all surfaces, in particular for the care of the human body skin, more particularly the face skin of women as well as men.

Of late years, the treating and/or the care of the human body skin and particularly of the face skin by applying various cosmetics thereon have made considerable strides as regards both women and men. This is due in particular to the fact that the care of the body and face epidermis is gaining increasing importance in our present-day hectic life and that the cosmetics nowadays offered on the market are very varied.

The process consisting in applying such products manually, i.e. by simply pressing one's fingers on the skin, is somewhat immethodical and does not permit rational skin massage. For example, if it is desired to apply on the face rejuvenating creams or even make-up foundation preparations, the result obtained in the long run will be far from comparing with that which would be obtained if the cosmetic fluid were distributed on the skin automatically and with controlled pressure.

This is why I proposed in my U.S. Pat. No. 3,943,591 a fluid-product projecting apparatus using in particular a working head provided with a rotary brush and into which can be injected a fluid product. This apparatus is entirely satisfactory as regards the maintenance of various surfaces, but I have found that an apparatus of such type can be improved still further in order to yield better and surprising results in the specific case of human body skin treatment and more particularly in some applications to the face skin of both women and men.

One of the purposes of the invention is therefore to provide a novel apparatus for projecting fluid projects permitting the maintenance or care and the treatment of all surfaces and particularly efficient in the treatment of the human body and more specifically of the skin of the face.

Another purpose of the invention is to provide an apparatus permitting the application of various fluid products such as toilet preparations, cosmetics, sanitary-care preparations for the body and even pharmaceutical products. Thus, the apparatus according to the invention may find a great number of applications in human-body care treatment in general.

To this end, the apparatus according to the invention comprises essentially: a casing with a fluid-product container portion; a working head comprising a brush rotatably mounted on the said casing; means for projecting the fluid product into the said working head; the said projecting means consisting of a hollow shaft jointly rotatable with and opening into the said working head, the said hollow shaft being connected to the outlet of a pump the inlet of which is connected to a suction tube dipping into the said container; a flux-conductive oscillating plate which is so mounted in the said casing as to be jointly rotatable with the hollow shaft and the two end faces of which extend each in confronting relationship to an electro-magnet secured to the inner surface of the said casing, the said electro-magnets being connected with means for alternately energizing the same to impart to the said working head an alternating rotary motion.

Thus, the working head carrying the brush and subjected to rapid and preferably small-amplitude oscillations is particularly favourable to the uniformity of the fluid-product distribution on the skin and of the massaging action produced thereon.

According to another characterizing feature of the invention, the said oscillating plate consists of a half-ring carried by at least one support arm attached to a sleeve freely rotatable round a conduit connecting the said suction tube to the said hollow shaft.

According to still another characterizing feature of the invention, the hollow shaft is jointly rotatable with the said sleeve and is arranged concentrically at the free end of the said conduit so as to rotate in the casing of the apparatus round the said end through the medium of rings, sleeve bearings, rolling bearings or the like.

The apparatus advantageously comprises a cap internally provided with a needle or the like so arranged as to extend through the working head to obturate the said hollow shaft.

According to still another characterizing feature of the invention, the apparatus comprises a resistor for heating the fluid product contained in the container.

According to a preferred form of embodiment, the said heating resistor is arranged concentrically on at least a portion of the suction tube dipping into the container.

The container is provided with electric current supply means such as for example a storage cell, it being understood that any other supply means, such as for example a storage battery or the like, may be used without departing from the scope of the invention.

The container may be so mounted as to be detachable from the apparatus to allow it to be refilled when empty.

Also, use can be made, as a container, of a cartridge of the disposable type available on the market.

Figure 4:
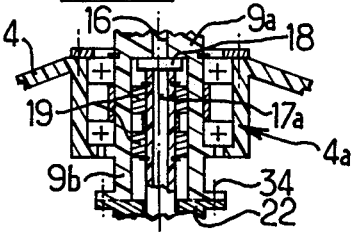
Figure 2:
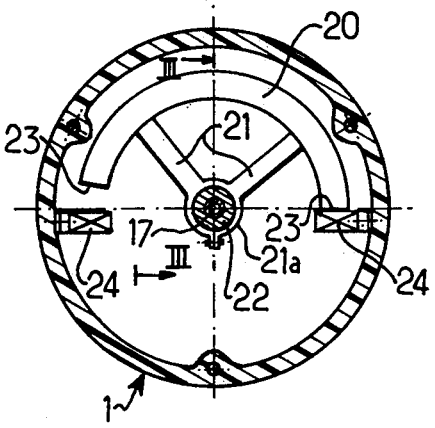
Figure 3:
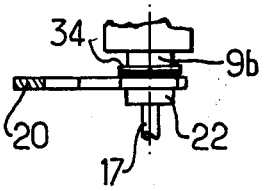
Figure 5:
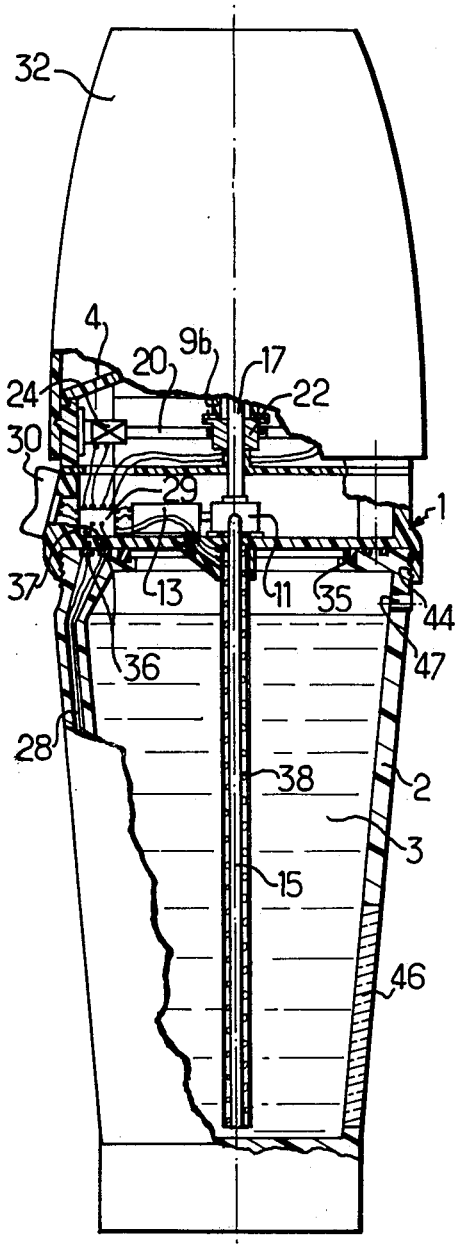
Figure 6:
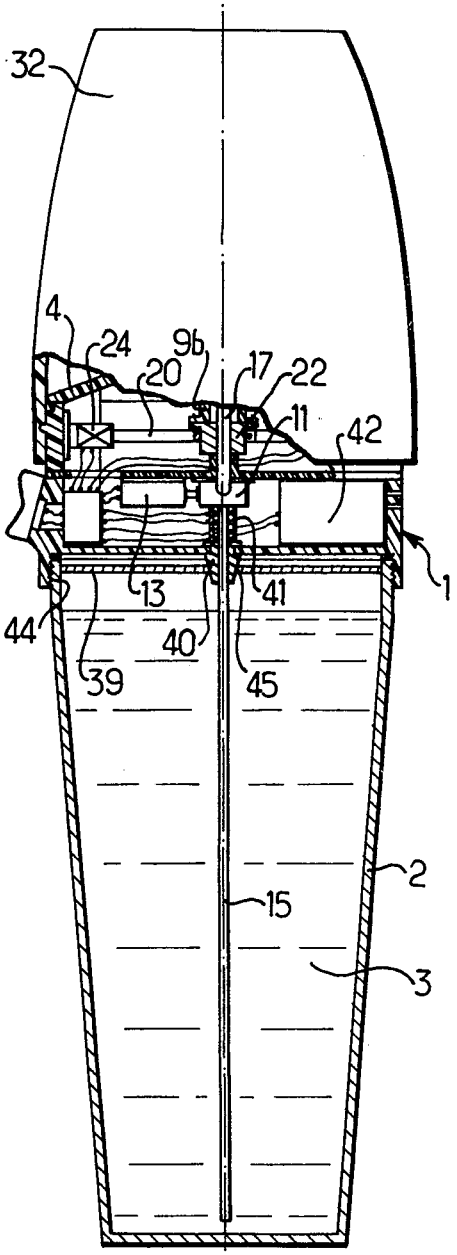

The invention will be better understood as the following explanatory description proceeds with reference to the appended drawings given solely by way of example and wherein:

FIG. 1 is a longitudinal axial sectional view of the apparatus according to the invention, FIG. 2 is a sectional upon the line II—II of FIG. 1, FIG. 3 is a sectional view substantially upon the line III—III of FIG. 2, FIG. 4 is an enlarged view of the connection between the hollow shaft and the discharge conduit, FIG. 5 is an axial sectional view of an apparatus according to the invention using a detachable refill container, and FIG. 6 is an axial sectional view illustrating another form of embodiment of the apparatus according to the invention, using a container in the form of a disposable cartridge.

According to one example of embodiment of the invention and referring particularly to FIGS. 1 to 4, an apparatus for projecting a fluid product, particularly for the treatment and care of the human body skin, comprises essentially a casing 1 the lower portion 2 of which constitutes a container 3 for various fluid products, and the upper portion 4 of which is topped by a working head 5 which will be described in more detail later.

The container 3 can of course contain any suitable fluid product, which may be for example a more or less viscous cosmetic product appropriate to the desired treatment. The product can be introduced into the container 3 through the medium of a filling nipple or the like 6 and may be for example a cosmetic or toilet product, a pharmaceutical product, a cream, e.g. a shaving cream, a make-up foundation product, etc.

The working head 5 is essentially constituted by a plate or the like 7 serving a support for brush bristles 8. Instead of the bristles 8, however, use can as well be made, without departing from the scope of the invention, of a sponge pad (more suitable for the application of make-up foundation) or small boxwood balls for activating blood circulation.

As seen clearly in FIG. 4, the hollow shaft 9 comprises a lower portion 9*b* arranged concentrically with the upper end 17*a* of conduit 17 so as to be rotatable round the latter through the medium of appropriate means such as sleeve bearings, rolling bearings or the like 19. Thus, the end 17*a* of conduit 17 remains in perfect axial alignement with the duct 16 of the hollow shaft 9 during the rotation of the latter. It will be noted here that the lower portion 9*b* of the hollow shaft 9 is rotatably mounted within the upper portion 4 of the casing 1 of the apparatus, which portion 4 serves, to this end, as a bearing assembly as shown diagrammatically and denoted at 4*a*.

According to an essential characterizing feature of the invention, the magnetic-flux conductive plate 20 in the shape of a half-ring (FIG. 2) is mounted so as to oscillate within the casing 1 of the apparatus.

More precisely, the half-ring 20 is carried by support arms 21 interconnected at their other end by a common portion 21*a* allowing the half-ring to be attached, as by a clamp or the like, on a sleeve 22 freely rotatable round the conduit 17. The end faces of the half-ring 20 each extend in confronting relationship to an electro-magnet coil 24 secured to the inner surface of casing 1. As clearly seen in FIG. 2, the electro-magnets 24 are mounted diametrically opposite one another within the casing 1.

At the lower portion of the container 3 is provided a cavity closed by a cover 25 and intended to accommodate at least one battery cell 26 which, through the medium of a junction box 27 and a wiring 28 incorporated in portion 2 of the casing 1, are intended to supply the coils 24. More precisely, at 29 are diagrammatically shown the means for alternately energizing the electromagnets 24. As seen clearly in FIG. 1, the wiring 28 ends at a unit 29 electrically connected to the electromagnets 24 and to the motor 13 driving the pump 11. A switch button 30 is provided on the side of casing 1 to either start or stop the apparatus.

A heating resistor 31 is mounted in the container 3 to allow the fluid contained therein to be heated or warmed if suitable. This may be particularly desirable in some applications.

The working head 5 in rest position is protected by a cap 32 internally provided with a needle, tapering pin or the like 33 extending through the bristles 8 and obturating the duct 16 of the hollow shaft 9, as is clearly seen in FIG. 1.

The operation of the apparatus is directly inferred from the foregoing description. After filling the container 3 with the fluid product appropriate to the desired treatment, the switch 30 is acted upon to cause the fluid to be sucked through the tube 15 and projected into the brush 8 through the medium of the discharge conduit 17 and the duct 16 of the hollow shaft 9. Simultaneously, the electro-magnets 24 are alternately energized, thus causing the half-ring 20 and therefore the hollow shaft 9 attached at 34 to the sleeve 22, and therefore the brush bristles 8, to oscillate at the desired frequency. This ensures a perfect distribution of the fluid together with a particularly uniform and efficient massaging action for the treatment of the skin of the human body.

The apparatus illustrated in FIG. 1 comprises a container 3 which, in a way, is integrated to the body 1 of the apparatus. But as seen in FIG. 5, use can be made of a container 3 that is separable from casing 1 to allow it to be cleaned and refilled with fluid product. Thus, the upper portion of the container 3 may be provided with a thread in order to be screwed at 44 on the casing 1. Any other suitable means, such as for example snap-on means, may be provided to fasten the container 3 to the casing 1, without departing from the scope of the invention. In this case, a seal 35 is provided between the container 3 and the casing 1, and the wiring 28 is electrically connected to conductive metallic paths provided at the upper portion of the container along its periphery and contacting the studs or like contact elements 37 provided in the casing 1 opposite the said paths. Consequently, when the container 3 is mounted on the casing 1, the working head is automatically supplied with electric current. According to the form of embodiment illustrated in FIG. 5, the suction tube 15 is surrounded at least partially with a heating resistor 38 in the form of a helical filament incorporated in a sheath or the like surrounding the tube 15. The resistor 38 is of course secured to the tube 15 and remains secured thereto when the user desires to remove the container 3 to either clean it or refill it.

In the form of embodiment illustrated in FIG. 6, substantially the same means as in the apparatus of FIGS. 1 and 5 are used, except that the container 3 is constituted in this case by a disposable cartridge temporarily secured, e.g. screwed, on the casing 1 at 44 and provided in its top portion with a wall 39 with an orifice 45 which is initially closed and can be opened manually or by simply perforating it with the end of the tube 15. Thereafter the cartridge-container 3 is merely engaged onto a protuberance 40 provided on the casing 1 and ensuring the fluid-tightness of the cartridge mounted on the apparatus.

There may also advantageously be provided, in the form of embodiment of FIG. 6, the heating resistor such as 41 surrounding the suction tube 15 only on its portion contained in casing 1. Lastly, use may be made, as a supply current source, of a small rechargeable battery 42 which, of course, is accommodated in the casing 1 as seen clearly in FIG. 6.

There may be provided on the container 1 a window or the like allowing the user to see the level of the product contained therein, as shown at 46 in FIGS. 1 and 5. Also, a hole provided with a small vent valve may be provided on the container, as shown at 47 in FIGS. 1 and 5.

The use of a container in the form of a disposable cartridge may be particularly desirable in the present case, since such cartridges are conveniently manufactured nowadays. Furthermore, since the cartridges are standard and easily interchangeable, and since the apparatus of the invention is suitable for multiple applications as mentioned earlier, the user may employ the kind of cartridge that is appropriate to the contemplated particular application and treatment.

There is therefore obtained, according to the invention, an apparatus that is particularly simple and efficient in the care and treatment of the skin of the human body and particularly the face, and which permits the use of various fluid products such as cosmetics, lotions, creams, toilet preparations, rejuvenating unguents, etc, and generally all products for sanitary care of the epidermis.

The apparatus according to the invention may also be used for projecting liquid dentifrice preparations, in this case for tooth cleaning purposes.

Of course the invention is by no means limited to the forms of embodiment described and illustrated, which have been given by way of example only. In particular, it comprises all means constituting technical equivalents to the means described as well as their combinations should the latter be carried out according to its gist and used within the scope of the following claims.

What I claim is:

1. In an apparatus for projecting a fluid product for the maintenance or care and the treatment of all surfaces, including the skin of the human body, comprising: a casing with a container portion for the fluid product; a working head comprising a brush movable in rotation on the said casing; means for projecting the fluid product into the said working head, the said projecting means being constituted by a hollow shaft jointly rotatable with the working head and opening into the latter, the said hollow shaft being connected to the outlet of a pump whose inlet is connected to a suction tube dipping into the said container, the improvements consisting in that in the said casing is mounted a flux-conductive oscillating plate or the like jointly rotatable with the hollow shaft and the end faces of which extend each in confronting relationship to an electromagnet secured to the internal surface of the said casing, the said electro-magnets being connected to means for alternately energizing the same so as to impart to the said working head an alternating rotary motion.

2. An apparatus according to claim 1, characterized in that the said oscillating plate is a half-ring which comprises at least one support arm and a sleeve jointly rotatable with the said arm, which arm is freely rotatable around a conduit connecting the said suction tube to the said hollow shaft.

3. An apparatus according to claim 2, characterized in that the hollow shaft is jointly rotatable with the said sleeve and is arranged concentrically at the free end of the said conduit so as to rotate in the said casing around the said free end through the medium of rings, sleeve bearings, rolling bearings or the like.

4. An apparatus according to claim 1, characterized in that it also comprises a cover provided internally with a needle or the like adapted to extend through the working head to obturate the said hollow shaft.

5. An apparatus according to claim 1, characterized in that it comprises a resistor for heating the fluid product contained in the said container.

6. An apparatus according to claim 5, characterized in that the said heating resistor is arranged concentrically on at least a portion of the said suction tube.

7. An apparatus according to claim 1, characterized in that the said container comprises current supply means such as for example a storage cell.

8. An apparatus according to claim 1, characterized in that the said container is detachable from the casing of the apparatus.

* * * * *